US008881825B2

(12) United States Patent
White et al.

(10) Patent No.: US 8,881,825 B2
(45) Date of Patent: Nov. 11, 2014

(54) BARRIER SIDE POCKET MANDREL AND GAS LIFE VALVE

(75) Inventors: Thomas M. White, Spring, TX (US); Wayne J. Mabry, Humble, TX (US); Jason Kamphaus, Singapore (SG); Tyson Messick, Singapore (SG); Eric Lovie, Aberdeen (GB); Kenneth C. Burnett, III, Bartlesville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 462 days.

(21) Appl. No.: 13/165,849

(22) Filed: Jun. 22, 2011

(65) Prior Publication Data

US 2011/0315401 A1 Dec. 29, 2011

Related U.S. Application Data

(60) Provisional application No. 61/358,774, filed on Jun. 25, 2010.

(51) Int. Cl.

| | |
|---|---|
| ***E21B 34/06*** | (2006.01) |
| ***E21B 43/00*** | (2006.01) |
| ***E21B 43/12*** | (2006.01) |
| ***E21B 34/10*** | (2006.01) |

(52) U.S. Cl.

CPC ..... *E21B 43/123* (2013.01); *E21B 34/107* (2013.01)

USPC ..... 166/334.4; 166/372; 166/386

(58) Field of Classification Search

USPC ..... 166/325, 386, 372, 334.4

See application file for complete search history.

(56) References Cited

U.S. PATENT DOCUMENTS

| | | | | |
|---|---|---|---|---|
| 4,059,157 | A | 11/1977 | Crowe | |
| 6,082,455 | A | 7/2000 | Pringle et al. | |
| 6,422,312 | B1 * | 7/2002 | Delatorre et al. | 166/250.15 |
| 6,840,321 | B2 * | 1/2005 | Restarick et al. | 166/313 |
| 6,863,126 | B2 * | 3/2005 | McGlothen et al. | 166/242.1 |
| 7,228,909 | B2 | 6/2007 | Schmidt et al. | |
| 7,647,975 | B2 | 1/2010 | Messick et al. | |
| 2002/0040784 | A1 | 4/2002 | De Almeida | |
| 2006/0137881 | A1 | 6/2006 | Schmidt et al. | |

FOREIGN PATENT DOCUMENTS

| | | |
|---|---|---|
| WO | 2011102732 | 8/2011 |

* cited by examiner

*Primary Examiner* — Kenneth L Thompson
(74) *Attorney, Agent, or Firm* — Michael Stonebrook

(57) ABSTRACT

A gas lift barrier valve mandrel assembly includes a longitudinally extending tubular member that defines a production conduit and has a central longitudinal axis. A side pocket mandrel has a first pocket for accepting a gas lift barrier valve and has a first central axis. The side pocket mandrel has a second pocket for accepting a gas lift barrier valve and has a second central axis. The central axis of the production conduit, first axis and second axis are non-coaxial and are parallel to one another. A first passage fluidly connects an outside of the mandrel to an inside of the first pocket. A second passage fluidly connects the inside of the first pocket to an inside of the second pocket. A third passage fluidly connects the inside of the second pocket to the production conduit. A fourth passage connects the first pocket to the production conduit and allows insertion of a gas lift barrier into the first pocket. A fifth passage connects the second pocket to the production conduit and allows insertion of a gas lift barrier into the second pocket.

20 Claims, 2 Drawing Sheets

BARRIER SIDE POCKET MANDREL AND GAS LIFE VALVE

TECHNICAL FIELD

The present application generally relates to gas lift barrier valves and associated side pocket mandrels, and more particularly to a dual gas lift barrier valve and mandrel design.

BACKGROUND

The present application generally relates to a gas lift barrier and associated side pocket mandrel design. For purposes of communicating well fluid to a surface of a well, a well may include production tubing. More specifically, the production tubing typically extends down hole into a wellbore of the well for purposes of communicating well fluid from one or more subterranean formations through a central passageway of the production tubing to the well's surface. Due to its weight, the column of well fluid that is present in the production tubing may suppress the rate at which the well fluid is produced from the formation. More specifically, the column of well fluid inside the production tubing exerts a hydrostatic pressure that increases with well depth. Thus, near a particular producing formation, the hydrostatic pressure may be significant enough to substantially slow down the rate at which the well fluid is produced from the formation.

For purposes of reducing the hydrostatic pressure and thus, enhancing the rate at which fluid is produced, an artificial-lift technique may be employed. One such technique involves injecting gas into the production tubing to displace some of the well fluid in the tubing with lighter gas. The displacement of the well fluid with the lighter gas reduces the hydrostatic pressure inside the production tubing and allows reservoir fluids to enter the wellbore at a higher flow rate. The gas to be injected into the production tubing typically is conveyed down hole via the annulus (the annular space surrounding the production tubing) and enters the production tubing through one or more gas lift barrier valves.

A gas lift system can include production tubing that extends into a wellbore. For purposes of gas injection, the system includes a gas compressor that is located at the surface of the well to pressurize gas that is communicated to an annulus of the well. To control the communication of gas between the annulus and a central passageway of the production tubing, the system may include several side pocket gas lift mandrels. Each of the gas lift mandrels can have an associated gas lift barrier valve for purposes of establishing one way fluid communication from the annulus to the central passageway. Near the surface of the well, one or more of the gas lift barriers may be unloading valves. An unloading gas lift barrier opens when the annulus pressure exceeds the production tubing pressure by a certain threshold, a feature that aids in pressurizing the annulus below the valve before the valve opens. Other gas lift barriers, typically located farther below the surface of the well, may not having an opening pressure threshold.

The gas lift barrier can contain a one way check valve element that opens to allow fluid flow from the annulus into the production tubing and closes when the fluid would otherwise flow in the opposite direction. For example, the production tubing may be pressurized for purposes of setting a packer, actuating a tool, performing a pressure test, etc. Thus, when the pressure in the production tubing exceeds the annulus pressure, the valve element is closed to ideally form a seal to prevent any flow from the tubing to the annulus. However, it is possible that this seal may leak, and if leakage does occur, well operations that rely on production tubing pressure may not be able to be completed or performed. Thus, an intervention may be needed, which may be costly, especially for a subsea well.

Thus, there exists a continuing need for better ways to increase reliability of gas lift barrier valves and to prevent a gas lift barrier assembly/design from leaking.

SUMMARY

The following is brief summary of a combination of embodied features and is in no way meant to unduly limit any present or future claims relating to this application.

A gas lift barrier valve mandrel assembly includes a longitudinally extending tubular member that defines a production conduit and has a central longitudinal axis. A side pocket mandrel has a first pocket for accepting a gas lift barrier valve and has a first central axis. The side pocket mandrel has a second pocket for accepting a gas lift barrier valve and has a second central axis. The central axis of the production conduit, first axis and second axis are non-coaxial and are parallel to one another. A first passage fluidly connects an outside of the mandrel to an inside of the first pocket. A second passage fluidly connects the inside of the first pocket to an inside of the second pocket. A third passage fluidly connects the inside of the second pocket to the production conduit. A fourth passage connects the first pocket to the production conduit and allows insertion of a gas lift barrier valve into the first pocket. A fifth passage connects the second pocket to the production conduit and allows insertion of a gas lift barrier valve into the second pocket.

BRIEF DESCRIPTION OF THE FIGURES

The present disclosure can be understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
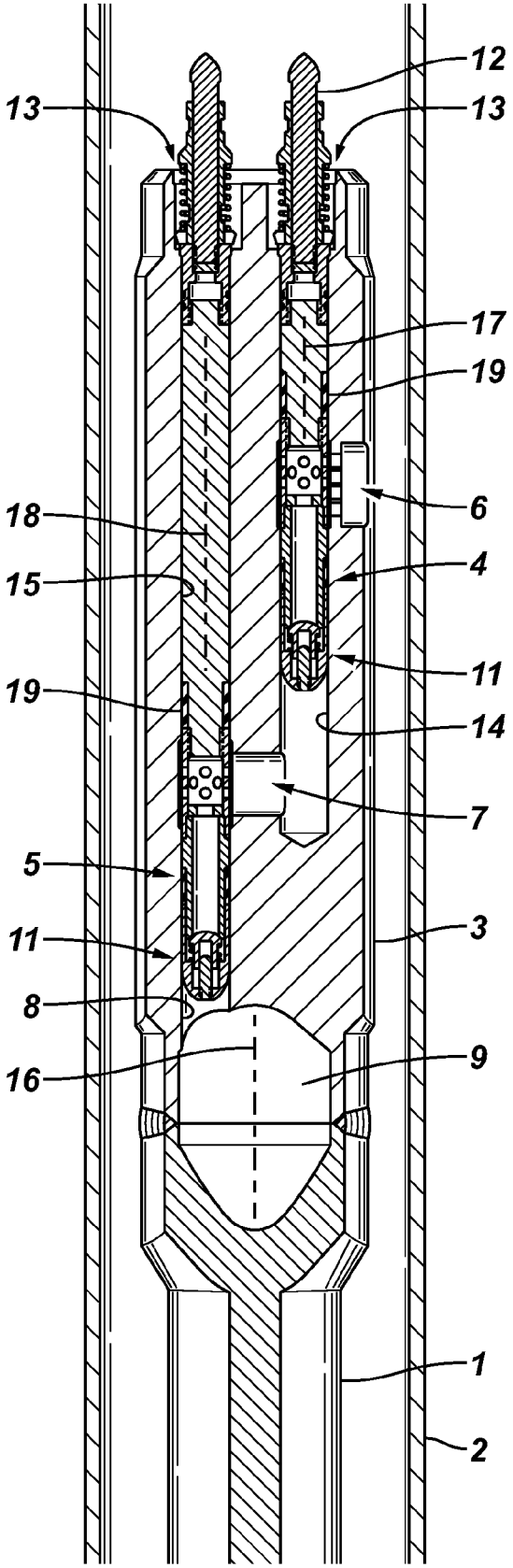
FIG. 1 is a side sectional schematic view of a gas lift system according to various embodiments.

In the following description, numerous details are set forth to provide an understanding of present embodiments. However, it will be understood by those skilled in the art that the present embodiments may be practiced without many of these details and that numerous variations or modifications from the described embodiments are possible. This detailed description is not meant in any way to unduly limit any present or future claims relating to the present application.

As used here, the terms "above" and "below"; "up" and "down"; "upper" and "lower"; "upwardly", "downwardly"; "up hole" and "down hole" and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

A gas lift barrier apparatus that is usable with a well includes a gas lift barrier valve and a side pocket mandrel in connection with production tubing. The gas lift barrier includes a valve element that is located in a pocket connecting between an annulus and a production conduit of tubing. U.S. Pat. No. 7,647,975 and U.S. Pat. No. 7,228,909 discusses various aspects of gas lift barrier valves and associated side pocket mandrels and are incorporated herein by reference in their entirety to provide some background in this area.

To begin, side pocket mandrels serve as a down hole receptacle for slickline retrievable gas lift barrier valves and flow control devices. Side pocket mandrels contain an offset pocket. The pocket configuration can allow the insertion and retrieval of a gas lift barrier valves or flow control devices, of various numbers, types and sizes, with a slickline conveyed kick-over, running and/or pulling tools. The gas lift barriers and flow control devices can incorporate an integral in-line reverse flow check valve to prevent well fluids from flowing in a reverse direction through the valve or flow control device. When installed with a gas lift barrier or flow control device in a side pocket mandrel, this reverse flow check valve also serves as a pressure barrier between the flow conduits and allows injection or fluid flow in only one direction. When the valve or flow control device, with the integral check valve, is removed from the side pocket mandrel well fluids are no longer adequately prevented from flowing in a reverse direction and as such there can be a communication between the production conduit and the casing annulus. It is desirable to have a design that can facilitate the operation, installation and retrieval of gas lift barrier valves and flow control devices, as similarly described above, while providing a capability and capacity to maintain a pressure barrier between the production and casing annulus when and after a gas lift barrier valve or flow control device is retrieved from the side pocket mandrel pocket.

Along those lines, the present application includes various embodiments where a side pocket mandrel has independent, separate, slickline retrievable or alternately deployed reverse flow check valve mechanisms (gas lift barrier valve(s)) that allow for continuous pressure integrity while allowing independent and selective operation, retrieval and installation of a gas lift barrier or flow control device while also maintaining the benefits similar to that of a standard side pocket mandrel. Additionally, various embodiments of the side pocket mandrel design will utilize gas lift barrier and flow control device conveyance tools (including kick-over tools, running tools and pulling tools).

Various embodiments relate to a dual parallel pocket or multiple parallel pocket side pocket mandrel designs. At least two internal parallel pockets can be utilized where one pocket is ported or communicating with the external (exterior) side of the mandrel body (annulus) while also in direct communication with the second or other parallel pocket(s) which will house the primary flow control device (gas lift barrier valve) and will communicate and regulate the fluid flow through the parallel pocket(s) between the casing conduit (annulus) and the tubing production conduit. The first pocket bore can contain a slickline retrievable or alternately deployed barrier check valve system and locking mechanism which can be the primary pressure barrier for the system assembly. The second or alternate pocket bore(s) can contain the primary slickline retrievable or alternately deployed flow control device(s) and locking mechanism(s). The barrier check valve system (located in the first pocket bore) can prevent misdirected fluid flow or pressure communication between the production conduit and casing conduit during and when the primary retrievable flow control device and locking mechanism is removed from the second or alternate pocket bore(s).

An embodied feature is a flow path and communication configuration between the exterior of the side pocket mandrel, through the parallel pocket bores, and to the interior main production conduit (bore) of the side pocket mandrel. This configuration of bores, pockets and communication portals will allow for the use of two (or more) separate and distinct retrievable flow control devices that will work independently to serve the flow control and pressure barrier requirement of the system. Each of the pocket bores may be consistent with side pocket mandrel designs and fluid flow configurations or be of a unique design that will facilitate variable flow configurations. Either design will facilitate standard gas lift flow configurations where gas or fluid flows from the casing annulus to the production conduit or from the production conduit to the casing annulus, chemical injection flow configurations where fluids flow from the casing annulus to the production conduit or from a separate external conduit (control line) from the surface to the side pocket mandrel pocket bore, or water flood flow configurations where fluid flows from the production conduit to the casing conduit or any other flow configuration that may be dictated by the operating oil or gas well conditions.

Some benefits associated with these present embodiments are that a long term positive sealing system (barrier gas lift barrier and barrier side pocket mandrel) will provide gas lift systems with a redundant pressure barrier system during different phases of operation with zero or minimal fluid release after their closure. This could offer a cost effective and positive closure system to reduce the potential for inadvertent hydrocarbon releases into the environment, e.g., when well shut-in is required in wells where a gas lift system is present.

Looking more specifically at some preferred embodiments, the present application relates to gas lift mandrels and the associated gas lift barrier valves. As noted earlier, an issue that is common and continually addressed in this area of technology is the prevention of flow from inside the mandrel and/or production tubing out via failed or faulty gas lift barrier valves and into the annulus outside the mandrel and/or production tubing. One way to address this issue is by using two gas lift barrier valves to provide a dual barrier and increase the overall one-way-check valve functionality and reliability. Given the desire to have each valve be replaceable and accessible while down hole, it is advantageous to provide a parallel and adjacent configuration where one valve can be removed while maintaining a one-way-check-valve function between inside the mandrel and the outside of the mandrel.

FIG. 1 shows a combination of embodied features along these lines. A side pocket mandrel 3 is connected with production tubing 1 that is located within a wellbore lined with casing 2. The side pocket mandrel 3 has a production conduit 9 that extends though the middle of the production tubing 1 and the side pocket mandrel 3. The production conduit 9 has a central axis 16. A first pocket 14 is located in the side pocket mandrel 3 and is located adjacent to the production conduit 9. The first pocket 14 has a central axis 17. A second pocket 15 is located in the side pocket mandrel 3 and has a central axis 18. The pockets 14 and 15 can be cylindrical in shape.

A first gas lift barrier valve 4 is located in the first pocket 14. The first gas lift barrier valve 4 forms a seal 19 with the inside of the pocket 14. A one-way-check-valve 11 in the gas lift barrier valve 4 allows flow only in one direction. A port 6 connects the outside of the side pocket mandrel 3 to the inside of the first pocket 14 and the inside of the first gas lift barrier valve 4. Gas can pass though the port 6 and through the one-way-check-valve 11 into a port 7. From the port 7 the gas can pass into the second pocket 15 and into the second gas lift barrier valve 5. The gas passes though a one-way-check-valve 11 of the second gas list barrier valve 5 and though an opening 8 into the production conduit 9. The second gas lift barrier valve 5 has a seal 11 that seals with the inside of the second pocket 15. Due to the seals 11 of the first gas lift barrier valve 4 and the second gas lift barrier valve 5, gas traveling along the aforementioned path is prevented from passing into the production conduit 9 by way of openings 13 to each pocket. Each opening 13 connects with either the first pocket 14 or the second pocket 15. The openings 13 are used to place the gas lift barriers into the pockets.

The side pocket mandrel 3 is integrated with the production tubing 1. The outside diameter of the side pocket mandrel 3 portion is generally larger than the outside diameter of the production tubing 1, while the contour of the production conduit 9 remains substantially uninterrupted.

As shown in FIG. 1, the first gas lift barrier 4 is adjacent to the second gas lift barrier 5 and overlaps with the second gas lift barrier in a direction perpendicular to the axis 16. The first gas lift barrier 4 and the second gas lift barrier can be offset in the axial direction. The offset positioning can facilitate flow and connection between the first pocket 14 and the second pocket 15. This configuration can be advantageous to allow for gas flow into the port 6, through the gas lift one way check valves and into the conduit 1. Of course, other variations on this configuration are possible.

Figure 2A:
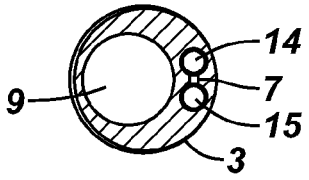
FIG. 2A is a top sectional schematic view of a gas lift system according to various embodiments.
Figure 2B:
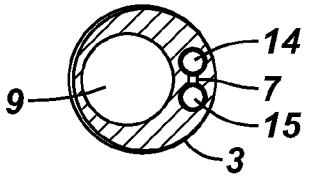
FIG. 2B is a top sectional schematic view of a gas lift system according to various embodiments.
Figure 3A:
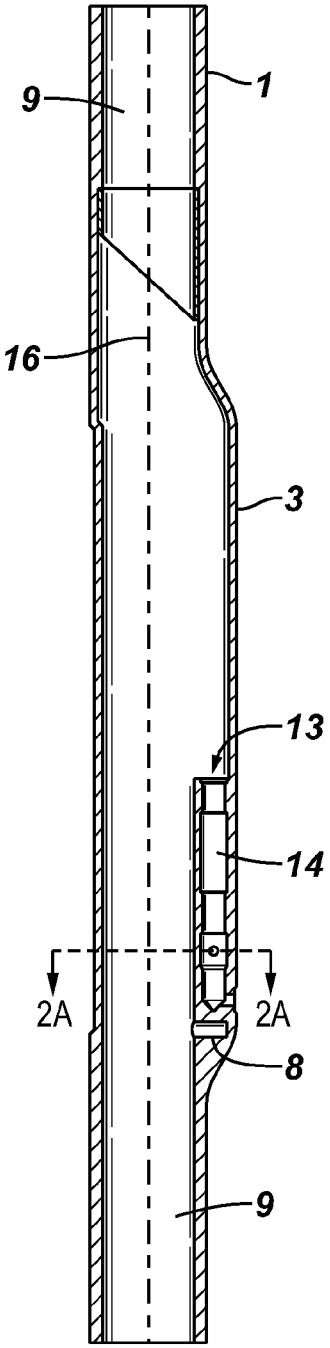
FIG. 3A is a side sectional schematic view of a gas lift system according to various embodiments.
Figure 3B:
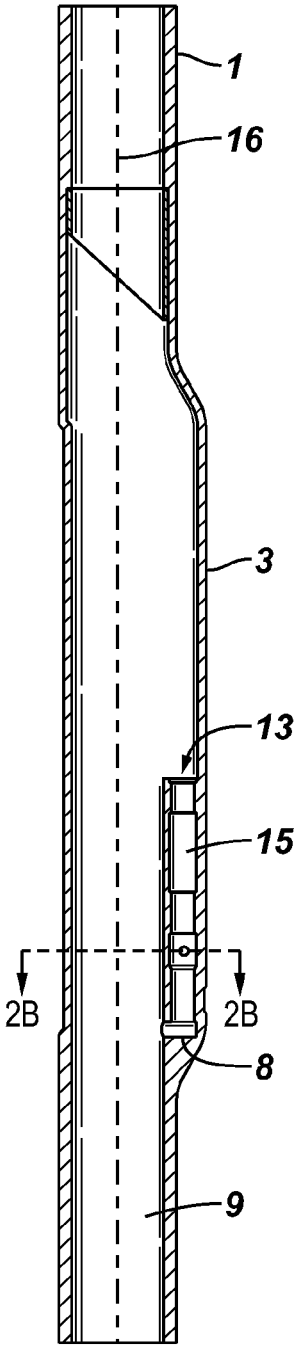
FIG. 3B is a side sectional schematic view of a gas lift system according to various embodiments.

FIGS. 2A and 2B show a sectional top view corresponding to FIGS. 1, 3A and 3B respectively. The first pocket 14 is adjacent and parallel to the second pocket 15. Also, the passage 7 connects the first pocket 14 to the second pocket 15. The cross section here also shows the cross section of the side pocket mandrel portion 3 having a larger outside diameter than the production tubing 1 as noted earlier.

FIGS. 3A and 3B show sectional side views of the embodied design shown in FIGS. 1, 2A and 2B. In FIG. 3A, the sectional side view shows the first pocket 14 connecting with the passage 6 to the outside of the side pocket mandrel 3. Also, FIG. 3A shows the contour of the side pocket mandrel portion 3. The central axis 17 of the first pocket 14 is adjacent to and substantially parallel to the central axis 16 of the production conduit 9. FIG. 3B shows a side sectional view with the second pocket 15. The second pocket 15 connects with the inside of the production conduit 9 by way of the passage 7. Together, FIGS. 3A and 3B illustrate the substantially parallel and adjacent positioning between the first pocket 14 and the second pocket 15.

The preceding description is meant to provide one skilled in the art with an adequate understanding of various embodiments and features of the present patent application. The disclosures and description s are not meant in any way to unduly limit any present or future claims relating to this application.

What is claimed is:

1. A gas lift barrier valve mandrel assembly, comprising:

a longitudinally extending tubular member defining a production conduit and having a central longitudinal axis;

a side pocket mandrel having a first pocket for accepting a gas lift barrier valve, the first pocket having a first central axis;

a first gas lift barrier valve located in the first pocket wherein the first gas lift barrier valve contacts an inner surface of the first pocket to form a seal and divide the first pocket into a first sealed side and a second sealed side;

the side pocket mandrel having a second pocket for accepting a gas lift barrier valve, the second pocket having a second central axis;

wherein the central axis of the production conduit, first axis and second axis are non-coaxial and are parallel to one another;

a first passage fluidly connecting an outside of the mandrel to an inside of the first pocket;

a second passage fluidly connecting the inside of the first pocket to an inside of the second pocket;

a third passage fluidly connecting the inside of the second pocket to the production conduit;

a fourth passage connecting the first pocket to the production conduit and allowing insertion of the first gas lift barrier valve into the first pocket; and a fifth passage connecting the second pocket to the production conduit and allowing insertion of a gas lift barrier valve into the second pocket.

2. The gas lift barrier mandrel assembly of claim 1, wherein the first passage extends substantially perpendicular to the first central axis.

3. The gas lift barrier mandrel assembly of claim 1, wherein the second passage extends substantially perpendicular to the second central axis.

4. The gas lift mandrel assembly of claim 1, comprising a second gas lift barrier valve located in the second pocket, the second gas lift barrier valve contacting the inner surface of the second pocket to form a seal and divide the second pocket into a first sealed side and a second sealed side.

5. The gas lift mandrel assembly of claim 4, wherein the first sealed side of the first pocket and the first sealed side of the second pocket are exposed to the production conduit by way of the fourth opening and the fifth opening respectively.

6. The gas lift mandrel assembly of claim 1, wherein the tubular member is connected with a wellhead and the tubular member is located down hole at a subterranean location.

7. The gas lift mandrel assembly of claim 6, comprising a gas compressor located at surface and connected with the annulus outside the tubular member to provide pressurized gas into the annulus.

8. The gas lift barrier valve mandrel assembly of claim 1, wherein the mandrel is designed to allow for placement and removal of the gas lift valve by way of a tool relayed by one selected from a list comprising: wireline, slickline and coil tubing.

9. A method of deploying a gas lift barrier system, comprising:

locating a gas lift mandrel down hole, the gas lift mandrel having a longitudinally extending tubular member defining a production conduit and having a central longitudinal axis;

a side pocket mandrel having a first pocket for accepting a gas lift barrier valve, the first pocket having a first central axis;

the side pocket mandrel having a second pocket for accepting a gas lift barrier valve, the second pocket having a second central axis;

wherein the central axis of the production conduit, first axis and second axis are non-coaxial and parallel to one another;

a first passage fluidly connecting an outside of the mandrel to the inside of the first pocket;

a second passage fluidly connecting the inside of the first pocket to the inside of the second pocket;

a third passage fluidly connecting the inside of the second pocket to the inside of the production conduit;

a fourth passage connecting the first pocket to the production conduit and allowing insertion of a gas lift barrier valve into the first pocket; and a fifth passage connecting the second pocket to the production conduit and allowing insertion of a gas lift barrier valve into the second pocket; and positioning a first gas lift barrier valve in the first pocket and positioning a second gas lift barrier valve in the second pocket.

10. The method of claim 9, comprising: locating the first gas lift valve in the first pocket with a tool lowered by way of one selected from a list consisting of: wireline, slickline and coil tubing.

11. The method of claim 9, comprising: locating the second gas lift valve in the second pocket with a tool lowered by way of one selected from a list consisting of: wireline, slickline and coil tubing.

12. The method of claim 9, comprising: removing the first gas lift valve from the first pocket with a tool relayed by way of one selected from a list consisting of: wireline, slickline and coil tubing.

13. The method of claim 9, comprising: removing the second gas lift barrier valve from the second packet with a tool relayed by way of one selected from a list consisting of: wireline, slickline and coil tubing.

14. A gas lift barrier valve system, comprising:

a production conduit;

a first pocket having a first gas lift barrier valve therein;

a second pocket having a second gas lift barrier valve therein;

a passage connecting the outside of the mandrel to the inside of the first pocket;

a passage connecting the inside of the first pocket to the inside of the second pocket;

a passage connecting the second pocket to the production conduit;

wherein the first gas lift barrier valve includes a one way check valve and the second gas lift barrier valve includes a one way check valve, the first gas lift barrier valve and the second gas lift barrier valve facilitating flow of gas from outside of the mandrel through the first passage into the first pocket, through the second passage to the second pocket, and through the opening into the production conduit;

the first pocket and first gas lift barrier valve being configured so that the first gas lift barrier overlaps with the second gas lift barrier valve in a direction perpendicular to the first axis.

15. The gas lift barrier valve of claim 14, wherein the one way check valve of the first gas lift barrier valve is offset in an axial direction with respect to the one way check valve of the second gas lift barrier valve.

16. The gas lift barrier valve of claim 14, wherein the first gas lift barrier valve comprises a seal that seals with the inside of the first pocket thereby dividing the second pocket into a first sealed side and a second sealed side, the one way check valve of the first gas lift barrier being on a down hole side from the seal of the first gas lift barrier valve.

17. The gas lift barrier valve of claim 16, wherein the first gas lift barrier valve comprises a seal that seals the inside of the second pocket thereby dividing the second pocket into a first sealed side and a second sealed side, the one way check valve of the second gas lift barrier valve being on a down hole side from the seal of the second gas lift barrier valve.

18. The gas lift barrier valve of claim 14, wherein the lowermost portion of the first gas lift barrier valve is at the same level or up hole from the one way check valve of the second gas lift barrier valve.

19. A gas lift barrier valve mandrel assembly, comprising:

a longitudinally extending tubular member defining a production conduit and having a central longitudinal axis;

a side pocket mandrel having a first pocket for accepting a gas lift barrier valve, the first pocket having a first central axis;

the side pocket mandrel having a second pocket for accepting a gas lift barrier valve, the second pocket having a second central axis;

wherein the central axis of the production conduit, first axis and second axis are non-coaxial and are parallel to one another;

a first passage fluidly connecting an outside of the mandrel to an inside of the first pocket;

a second passage fluidly connecting the inside of the first pocket to an inside of the second pocket wherein the second passage extends substantially perpendicular to the second central axis;

a third passage fluidly connecting the inside of the second pocket to the production conduit;

a fourth passage connecting the first pocket to the production conduit and allowing insertion of a gas lift barrier valve into the first pocket; and a fifth passage connecting the second pocket to the production conduit and allowing insertion of a gas lift barrier valve into the second pocket.

20. A gas lift barrier valve mandrel assembly, comprising:

a longitudinally extending tubular member defining a production conduit and having a central longitudinal axis wherein the tubular member is connected with a wellhead and the tubular member is located down hole at a subterranean location;

a gas compressor located at surface and connected with an annulus outside the tubular member to provide pressurized gas into the annulus;

a side pocket mandrel having a first pocket for accepting a gas lift barrier valve, the first pocket having a first central axis;

the side pocket mandrel having a second pocket for accepting a gas lift barrier valve, the second pocket having a second central axis;

wherein the central axis of the production conduit, first axis and second axis are non-coaxial and are parallel to one another;

a first passage fluidly connecting an outside of the mandrel to an inside of the first pocket;

a second passage fluidly connecting the inside of the first pocket to an inside of the second pocket;

a third passage fluidly connecting the inside of the second pocket to the production conduit;

a fourth passage connecting the first pocket to the production conduit and allowing insertion of a gas lift barrier valve into the first pocket; and a fifth passage connecting the second pocket to the production conduit and allowing insertion of a gas lift barrier valve into the second pocket.

* * * * *